US007752987B2

(12) United States Patent
Wiltz

(10) Patent No.: US 7,752,987 B2
(45) Date of Patent: Jul. 13, 2010

(54) COLLAPSIBLE PERIMETER SUPPORTED WIND PROPULSION DEVICE

(76) Inventor: Nicholas Mark Wiltz, 1315 C St., Hood River, OR (US) 97031

( * ) Notice: Subject to any disclaimer, the term of this patent is extended or adjusted under 35 U.S.C. 154(b) by 692 days.

(21) Appl. No.: 11/784,562

(22) Filed: Apr. 6, 2007

(65) Prior Publication Data

US 2009/0139438 A1 Jun. 4, 2009

Related U.S. Application Data

(60) Provisional application No. 60/790,857, filed on Apr. 11, 2006.

(51) Int. Cl.
*B63H 9/00* (2006.01)
*B63H 9/04* (2006.01)
*B63H 9/06* (2006.01)

(52) U.S. Cl. ..... 114/102.11; 114/39.11; 114/39.29; 114/102.1; 114/102.12

(58) Field of Classification Search ..... 114/39.11, 114/39.21, 39.22, 39.29, 39.3, 39.31, 102.1, 114/102.11, 102.12, 102.15, 102.22–102.27, 114/311; 244/153 R–153 A; 280/810
See application file for complete search history.

(56) References Cited

U.S. PATENT DOCUMENTS

| | | | | | |
|---|---|---|---|---|---|
| 4,178,867 | A * | 12/1979 | Shyu | 114/39.29 |
| 4,709,928 | A * | 12/1987 | Willingham | 273/309 |
| 4,958,582 | A * | 9/1990 | Vermillion et al. | 114/39.29 |
| 5,078,637 | A * | 1/1992 | McFarland | 446/46 |
| 5,642,683 | A * | 7/1997 | Bedford | 114/102.1 |
| 6,135,046 | A * | 10/2000 | Beech | 114/311 |
| 7,263,732 | B2 * | 9/2007 | Zheng | 5/417 |

* cited by examiner

*Primary Examiner*—Ajay Vasudeva

(57) ABSTRACT

A sail assembly having a single, closed-loop support batten that supports a flexible sail. The sail is a hollow body defining a substantially hemispherical shape when fully expanded by captured wind. The support batten is housed in a perimeter sleeve at the front end of the sail. The support batten is stiff enough to support the sail, yet elastic enough that it can be twisted and coiled as three contiguous coils for compact folding. The sail has a significantly smaller size in the folded and coiled orientation, and is capable of rapid self deployment due to the energy stored in the folded batten. The deployed sail can be fastened to the deck of a small watercraft, hand held, or fastened to the blade end of a paddle or oar for capturing the energy in the wind to propel a small watercraft.

7 Claims, 5 Drawing Sheets

COLLAPSIBLE PERIMETER SUPPORTED WIND PROPULSION DEVICE

CROSS-REFERENCES TO RELATED APPLICATIONS

This application is entitled to the benefit of Provisional Patent Application No. 60/790,857 filed Apr. 11, 2006.

STATEMENT REGARDING FEDERALLY SPONSORED RESEARCH OR DEVELOPMENT

Not Applicable.

BACKGROUND OF THE INVENTION (1) Field of the Invention

The invention relates to a sail device that may be used to power a land or water vehicle. More specifically, a mastless sail device that enables a land or water vehicle to be propelled by the wind.

(2) Description of the Related Art

Kayaks and canoes, because of their intrinsic lightweight and mobility can be easily powered by the wind. Using a sail to propel these small craft that are usually hand-powered with paddles or oars is very efficient and can be a huge work savings. It can also be fun!

In the case of canoes and kayaks, because of their inherent instability on water, using sail power has presented compromises in craft stability, simplicity and operator safety. Traditionally and currently, wind-powered vehicles use static mounted sails on the vehicle or the sail(s) are hand-held and flown free. Static mounted sails use booms, boomsticks, paddles, oars, stick, tree branches, straight battens or other stiff and linear-shaped support members to maintain both sail shape and sail orientation to the craft. In the case of free flown or hand held sails, strings and such are used. In all cases the sails have at least one supporting structure of lines, battens, masts, booms, boomsticks and stiffeners.

Safety is an issue with small watercraft as gusts of wind can upset and capsize small craft if the sail is unable to quickly release the force of the wind during these gusts or sudden changes in wind direction. For a sail to be safe it needs to be able to be capable of being almost instantly depowered.

One item of major importance is the location of the center of mass of the sail and its supporting structures. In the case of small water-craft such as kayaks and canoes, by raising the overall center of gravity of the craft with the occupants and equipment too far above the surface of the water can make the entire craft prone too capsize, creating a potentially grave safety issue. Large and heavy sails and sail structures can raise this center of gravity.

Weight and size also are considerations that play an important part when using a small craft sail, as in the case of sail devices, they are normally carried or transported in or on the craft when not in use. The sail supporting structure of lines, battens, masts, booms, boomsticks and/or stiffeners need to be carried on or in the craft ready for assembly and sail deployment. Often times these items are bulky, heavy and have involved assembly and launching procedures. Often the craft needs to be stopped, unloaded or brought to the shore or beach (in the case of a canoe, kayak or small watercraft) for the assembly of the sail.

For a sail to be simply set up and doused, especially while out on the water a sail needs to be as uncomplicated and have small and as few pieces to assemble. Often times paddlers are out on the water wearing gloves or water-proof mittens. To launch a sail it must be quickly removed from stowage, launched, sailed and then doused and stowed in a similar manner. Parts need to come with the sail and assemble quickly. The need to put the craft ashore to get parts or to assemble is cumbersome and often very awkward and time consuming.

When using sails with small craft for propulsion, stability for reasons of safety are important. Some sails are carried with a firm and static mounting to the craft that does not allow for quick dousing or de-powering. The ease and speed of taking down the sail is paramount to safety while sailing in a small watercraft like a canoe or kayak. If an increase in wind speed occurs, the sail if rigidly attached can be over powered and upset and potentially capsize the craft. The need to instantly douse the sail is an important safety consideration. The failure to reduce the force on a sail due to an increase of windspeed or change in wind direction can be of obvious danger, risking a watercraft to capsize.

A final consideration is the need for a paddler to keep his or her paddle or oar accessible or preferably in hand. In a kayaking or canoeing, a technique referred to as "bracing" is used where a paddler uses the paddle or oar to arrest an unstable orientation of the boat, thus preventing capsize. If the paddler is occupied using his or her hands with assembling and then launching a sail, said paddler is compromising their ability to react to and "brace" against a capsize when in uncalm water or rough sea conditions. It should be noted that with an increase in surface winds upon bodies of water bring with it a decrease in the calmness of the surface of the water. Simply stated, increasing wind velocities bring increasing water surface roughness, resulting in the decreasing stability of a kayak or canoe. These rough water or rough sea conditions are however exactly the conditions in which a kayak or canoe will be using sailing devices.

In the case of land craft, wind power can also be similarly applied to the vehicle with similar concerns and benefits.

Currently there are several kayak and canoe sails being manufactured of commercial importance.

The Spirit Sail is a v-shaped sail that is firmly connected to the boat. This connection requires time in fastening (launching) the sail. The connection also requires that the sail remain up and deployed without the ability to instantly douse or take down in the event of a sudden increase in wind speed. This sail also requires two long stiffening members that are to be carried with the sail while not in use. This is relatively cumbersome and heavy.

The QuiverSail is also a v-shaped sail with stiffening members that can be either fastened to the deck of a kayak or canoe or hand held.

The Zephyr sail is kite-like in its shape with no stiffeners and is free-flown from the kayak or canoe by two people.

The Pacific Action sails of New Zealand is again a v-shaped sail held with twin vertical masts and held in the vertical orientation with lines.

U.S. Patent Documents—for Sail Applications

U.S. Pat. No. 1,859,178 May, 1932 Sprinkle.

U.S. Pat. No. 4,082,049 April, 1978 Nicol.

U.S. Pat. No. 5,289,792 March, 1994 Forrest et al.

U.S. Pat. No. 5,377,607 January, 1995 Ross.

U.S. Pat. No. 6,390,013 May, 2002 Cornell.

U.S. Pat. No. 6,457,430 October, 2002 Drabkin.

U.S. Pat. No. 6,615,758 September, 2003 Blad.

U.S. Pat. No. 6,655,314 December, 2003 Housely et al.

U.S. Pat. No. 6,776,115 August, 2004 DeMeo.

U.S. Pat. No. 6,807,919 October, 2004 Thomsen.

Some mention must be made of collapsible rings or hoop structures because this is the physical perimeter structure that supports the invention.

Traditionally machine shop bandsaw blades were coiled and folded in a manner that reduced their overall size. A 42 inch diameter bandsaw blade for instance can be coiled into three equal sized coils with an overall dimension of approximately 16 inches. This made handling, storing and transporting much easier. Bandsaw blades are commonly very stiff and springy, constructed of "Spring Steel" of rectangular cross-section and welded end to end to form a loop, circle or hoop. With the proper technique the hoop can be twisted and folded not in half, which puts a twist in the material, but in three separate loops that eliminates this twist in the material and will not bend or break the material.

Recently hoop designs has been used as structural components to support tent structures, automobile windshield shades, kids wading pools and other items. Owing to the physical ability for geometric hoop shapes to fold and coil like the above bandsaw blade has made these designs attractive.

U.S. Patent Documents - For Hoop structures

| | | |
|---|---|---|
| 1,732,447 | October, 1929 | Crane. |
| 1,790,333 | January, 1931 | Tubman. |
| 1,808,652 | June, 1931 | Gump. |
| 2,596,836 | May, 1952 | Bruhl. |
| 3,336,969 | August, 1967 | Marchman. |
| 4,397,346 | August, 1983 | Chumbley et al. |
| 4,560,245 | December, 1985 | Sarver. |
| 4,561,039 | March, 1987 | Richards. |
| 4,647,102 | March, 1987 | Ebrahimzadeh. |
| 4,671,558 | June, 1987 | Cline. |
| 4,736,980 | April, 1988 | Eubanks. |
| 4,763,947 | August, 1988 | Gregg. |
| 4,775,180 | October, 1988 | Phillips. |
| 4,784,426 | November, 1988 | Mannisto-Iches. |
| 4,790,591 | December, 1988 | Miller. |
| 4,815,784 | March, 1989 | Zheny. |
| 4,818,007 | April, 1989 | Mahoney. |

The invention relies upon the unique physical and geometric properties of a rectangular cross-sectional hoop of very stiff but flexible material to resist deformation in torsion yet be able to be coiled and folded in the above described manner. The invention also relies on the spring force of the uncoiling of this structure to aid in the launching and deploying of the invention. Recent advances in physical materials has allowed for the construction of a hoop batten that will not break under extreme deformation stresses and is corrosion resistant.

There have also been advances in joining processes that can join these new materials, yet be flexible or elastic and not break or permanently bend which is the key to this invention. The invention uses a very stiff yet flexible linear member that is joined to form a circle or hoop. This material has high strength yet may be elastically deformed to a high degree to allow for its use as a foldable, coilable perimeter batten used in the invention, while having a high modulus of elasticity, resistance to corrosion as well as a high fatigue strength.

The coiling and folding of the invention is unique in terms of use.

BACKGROUND OF THE INVENTION

The invention needed a support structure that would act as a supporting perimeter hoop or batten. This member needed to be strong, lightweight, elastic and be able to be grossly deformed yet return to its original shape (high elasticity) and corrosion resistant (as it was subject to saltwater environments).

Another important concern was establishing a fastening system that would firmly join the two ends of a length of the material into a circle or hoop to be used as a perimeter supporting structure for the invention. This joint needed to be strong yet ductile enough to endure extreme folding and bending stresses.

SUMMARY

The invention is for a self-assembling, self-launching sail that propels craft by harnessing the power of the wind. Specifically, this invention is for a three-dimensional flexible sail containing a fixed, flexible and permanent internal perimeter member that supports the sail in an open or deployed position thus maintaining sail shape. In addition, the flexible perimeter member allows the sail to be compactly stowed into a fraction of its deployed dimension without any disassembly. This flexible perimeter member fits into a pocket or sleeve around the circumference of the sail. Other than the integral perimeter member, the invention does not make use of any integral masts, stiffeners, booms or boomsticks. The invention is a sail that is flown in the vertical orientation from either the oar/paddle (in its use with a canoe or kayak), attached to the deck of a water craft or hand-held.

The flexible perimeter batten allows the sail be self launching because of the stored energy contained in the coiled and folded state without any assembly required. The flexible perimeter batten also allows the invention to deform and de-power in strong gusts of wind, adding a measure of safety into its use and design. If a gust comes with either an increase in wind speed or with a change of direction, the sail can de-power, thus reducing the force on the sail. The invention can also be deformed from its natural circular shape into an increasingly oblong oval to decrease its sail size hence its ability to capture the wind, effectively reducing the wind generated force on the sail. The flexibility of the perimeter batten allows for this deformation The invention also has an integral storage pocket that when not holding the collapsed invention also fits over the oar or paddle for use if desired. The paddlers own oar or paddle may be used to hold the sail into the air. This paddle pocket/storage pouch is one of the means of attaching and holding the invention to the oar or paddle. The other attachment point is a Velcro fastener that connects to the shaft of the oar or paddle.

The sail can also be solely hand-held and there may be hand-hold cut-outs radially opposite in the sail. If a gust comes with an increase in windspeed or with a change of direction, the sail can depower, thus reducing the force on the sail. The depowering effect comes from the deformation or bending of the perimeter batten. If an additional decrease in the deployed sail power is required, the sail can be simply lowered towards the horizontal (the water), reducing the apparent sail area until the sail is held parallel to the wind direction essentially dousing the sail. The sail may also be directly mounted on the deck of the water craft.

The invention has it's own integral circular perimeter batten that deploys the sail and maintains shape for maximum efficiency as well as enabling the invention to be folded up upon itself without any disassembly. This feature allows the sail to be deployed and doused with a minimum of preparation or assembly or disassembly. The perimeter batten design also allows the sail to be stored in a package that is intergal to the function of the sail.

The invention relies upon the unique physical and geometric properties of a rectangular cross-sectional hoop of very stiff but flexible material. Recent advances in physical materials has allowed for the construction of a perimeter batten with high strength, high elasticity, will not break under use and is corrosion resistant. There have also been advances in joining processes and joining techniques that can join these new materials, yet be strong and flexible, which is the key to this invention.

The invention having a flexible perimeter batten enables the sail to be twisted and folded up upon itself without any disassembly of its parts for stowage. This feature allows the sail to be deployed and doused with a minimum of preparation in assembly or disassembly. The batten design also allows the invention to be stored in a package that is integral to the function of the sail with a 80% reduction in size. (The invention can be twisted and folded for storage to form a series of concentric loops resulting in an 80% reduction of area.)

When out on the water, especially in cold environments, the paddler often wears gloves making assembly operations cumbersome. Having a sail that will deploy instantly without the need for assembly is fast, convenient and safe hence desirable.

The sailcloth is made of cloth or similar material that is 3-dimensional in shape and is used to harnesses the wind resulting in a force that propels a craft. This 3-dimensional shape is stable when subjected and exposed to the wind. The invention claims that many differing 3-dimensional sailcloth shapes may be used that result in a stable sail when exposed to the force of the wind. Any 3-dimensional sail shape is more stable and efficient than a panel of cloth or a 2-dimensional sail shape. A three dimensional sail shape places the center of effort behind the perimeter batten and thus the mounting points, making the sail stable.

The invention allows for the following benefits as compared to other small craft sails that have been developed;

lighter in mass when compared to similar sized sail devices smaller stowed or doused size quicker and easier launching, deploying and dousing

Object

The object of the invention is to provide a lightweight and stable sail that can be easily and quickly deployed and disassembled in a small craft by a single person while out on the water. Another object is to provide a self-contained small craft sail that can be used without the need for supports, lines, masts, booms, boomsticks or anything else other than perhaps the craft operator's own paddle or oar, hand-held or fastened and flown from the deck of a watercraft. A further object is the ability of the invention to deform or spill wind in the event that a wind gust hits the sail and threatens to overturn or capsize the craft. This sail deformation can happen from the force of the wind or by a manual deformation of the sail. Yet another object is the ease of which the invention can be taken out of service, doused or disassembled and the small space it can thus be stored, (20% of the deployed area). A final object of the invention is to provide a sail that can be uncomplicated in its operation.

The invention can be deployed in a fraction of the time of other small-craft sails because of the coiled nature of the undeployed shape and the spring or self-launching and self assembling construction. The coiled and stowed perimeter batten expands when released from restraint, effectively opening the sail, allowing the wind to fill the invention and start propelling the craft.

The invention, as well as being less timely in its assembly and deployment is lighter in mass and smaller in stowed dimension than other sails available of unavailable. The operation of the invention is much less complicated than other sails available or unavailable as there are no booms to assemble, fix upon the craft, nor masts, boomkins or boomsticks.

REFERENCE NUMERALS IN THE DRAWINGS

1—perimeter support batten
2—overlap joint area
3—flexible sail structure
4—perimeter sleeve for housing the perimeter support batten
5—stowage pocket
6—deck attachment members

DESCRIPTION OF INVENTION

Figure 1:
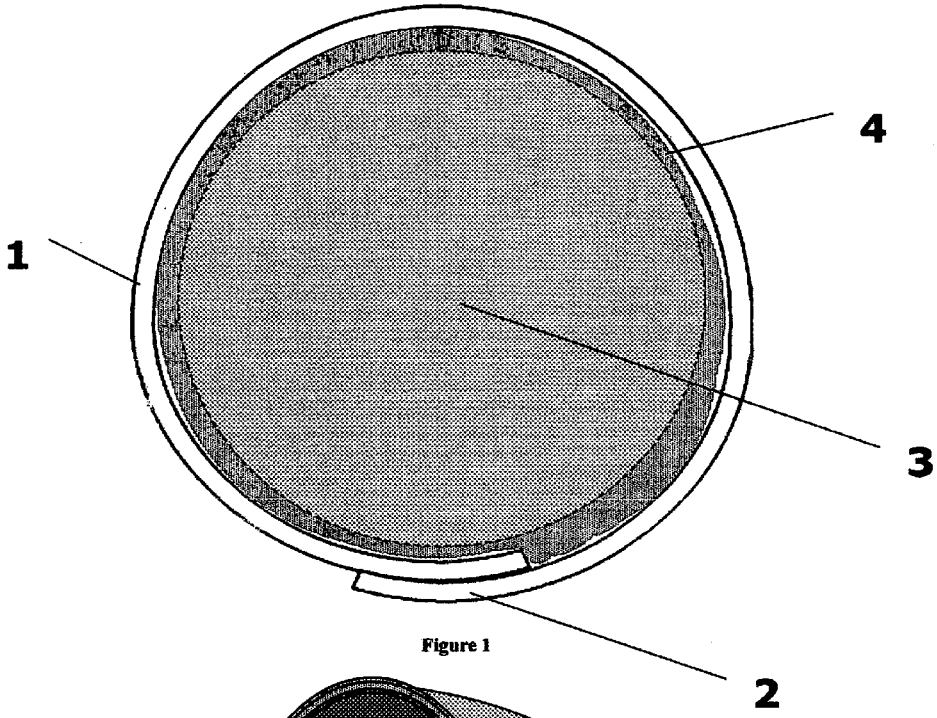
FIG. 1 is a front view of the invention showing the sail area surrounded by a perimeter support batten.
Figure 2:
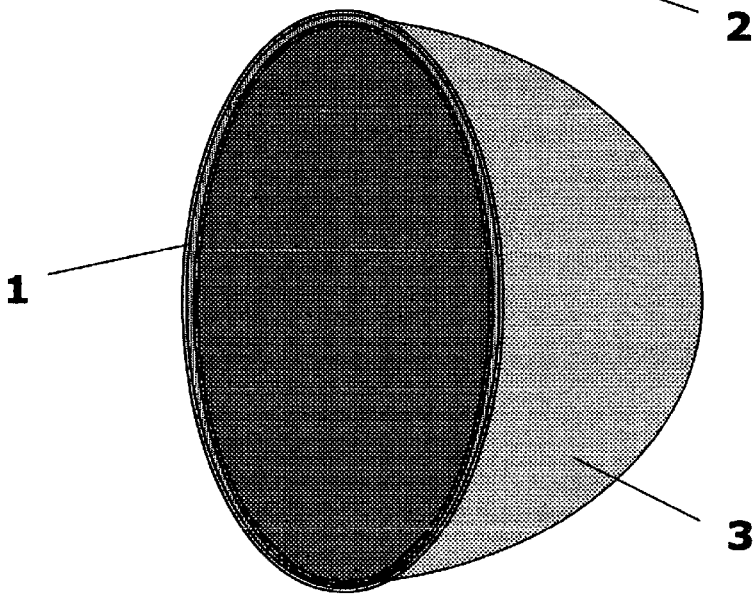
FIG. 2 is an isometric view of the instant invention without the attachment devices.
Figure 3:
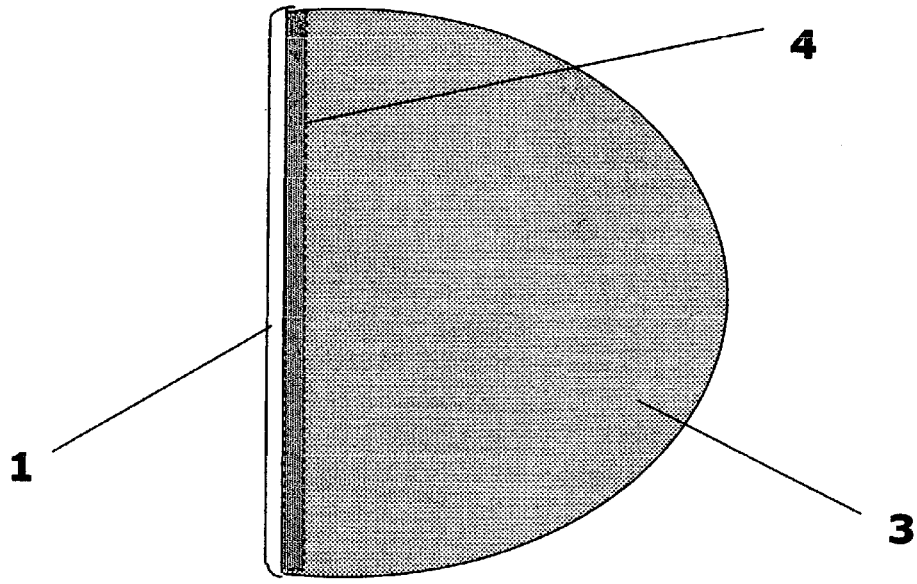
FIG. 3 is a side view of the invention without various attachment devices.
Figure 4:
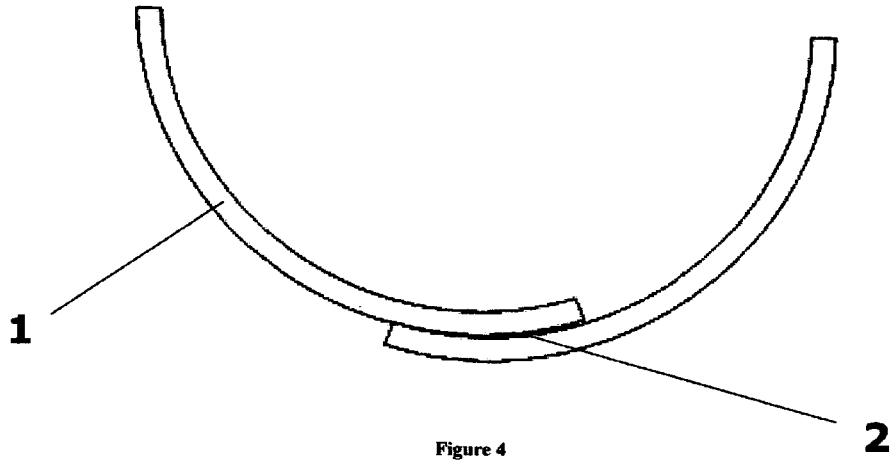
FIG. 4 is a close-up of the overlap that creates the circular perimeter support batten from a linear length of material.
Figure 5:
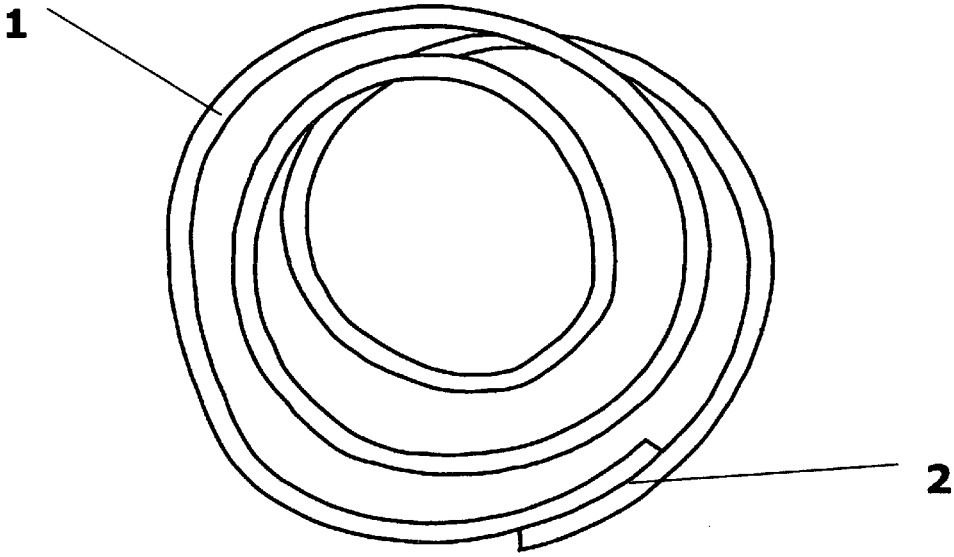
FIG. 5 is a view of the coiled perimeter member without the sail material and various attachment devices. The coil shows the single perimeter support batten coiled into three concentric circles.
Figure 6:
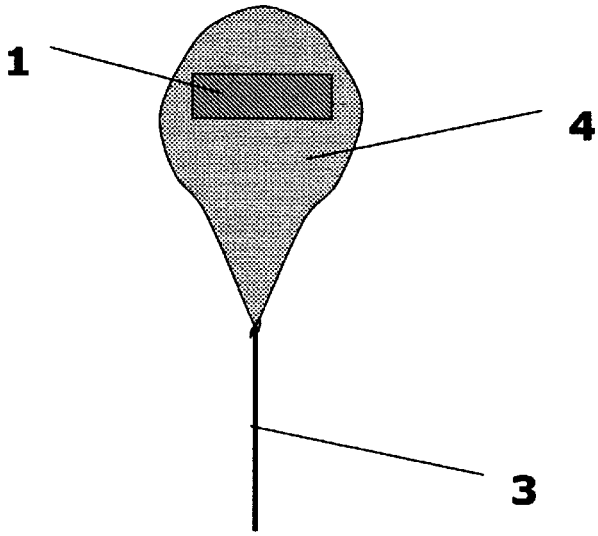
FIG. 6 is a cross-sectional view of FIG. 1 showing the perimeter support batten housed in a perimeter sleeve of the sail.
Figure 7:
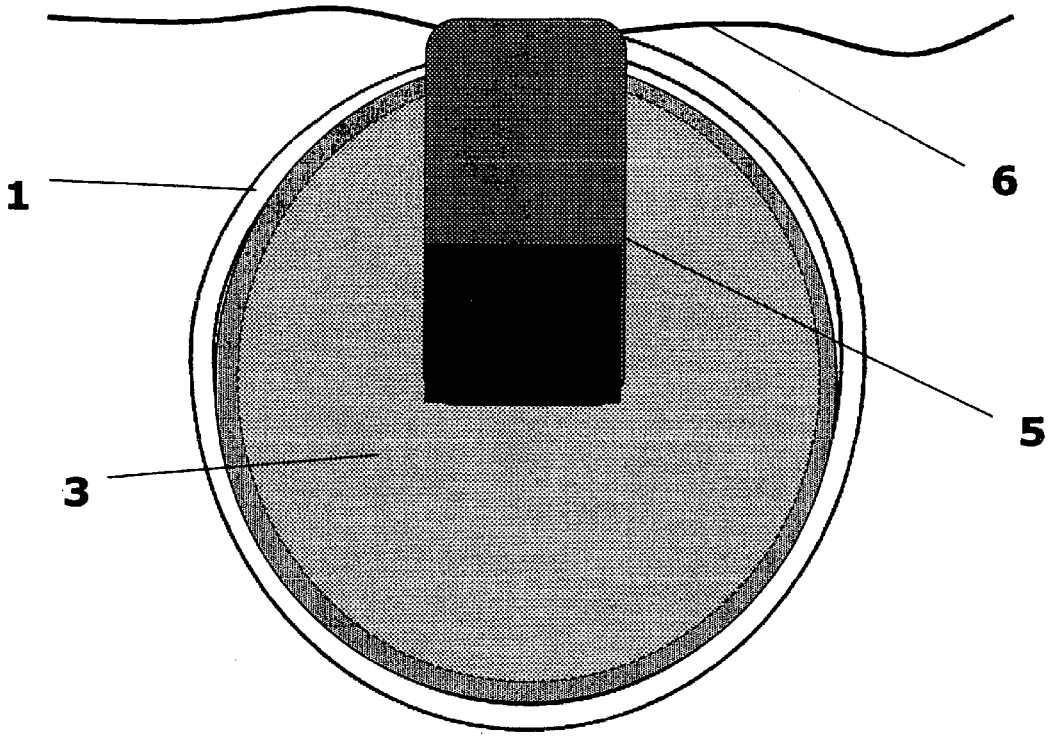
FIG. 7 is a front view of the invention showing the stowage pocket and the deck mounting member.
Figure 8:
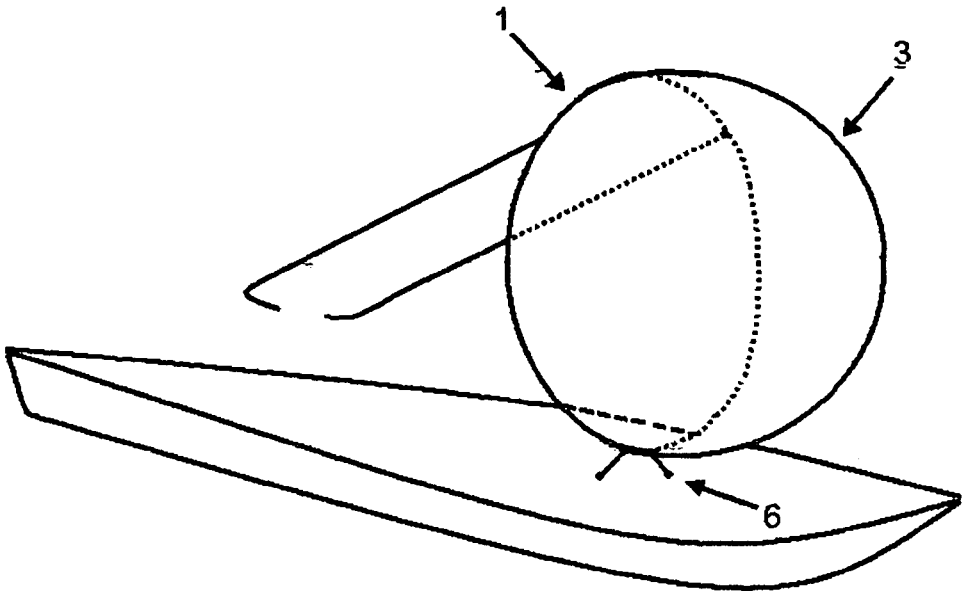
FIG. 8 is a perspective view of the invention showing the sail attached to a watercraft.

The invention is a sail device used for propelling watercraft and land vehicles. The invention is constructed of a substantially rigid, yet foldable and elastic perimeter support batten 1 that supports a flexible sail structure 3 to capture the energy of the wind for propelling a land vehicle or watercraft downwind. The flexible sail structure 3 is a hollow body defining a substantially hemispherical shape when fully expanded by the captured wind (FIG. 3). The flexible sail 3 can be constructed using transparent and/or non-transparent material, such as fabric. A perimeter sleeve 4 is provided at a front end of the sail 3 for housing the support batten 1. The support batten 1 is a single, closed-loop structure made of a resilient material. The invention uses the unique properties of its perimeter support batten 1 to both support the wind-harnessing flexible sail structure 3, as well as to compactly fold itself into a geometrical size less than 20% of its original deployed size when the support batten 1 is twisted and coiled upon itself as three contiguous coils. The sail 3 is capable of rapid self deployment due to the energy stored in the folded batten. The sail has deck attachment members 6 for fastening to a deck of a small watercraft and an integral stowage pouch 5 for storing the sail 3 in a folded configuration.

The perimeter support structure also allows the invention to be quickly and instantly launched from its stowed orientation or configuration into its deployed and employed orientation or configuration due to the intrinsic stored energy of the coiled and folded stowed configuration. This quick and easy launching capability is of tremendous benefit when being used while out on the water in a small sea-craft, watercraft, kayak, paddleboard or canoe.

The ability of the invention to be depowered in the event of a sudden gust of wind or a change of wind directions is also of great benefit to small watercraft, as the risk to sudden capsize is greatly reduced.

The ability of the invention to be folded, coiled and stowed is of great importance when being used or employed on small watercraft is of great benefit as the size of the article is reduced up to approximately 20% of its originals size. There is not an abundance of storage space available on small watercraft.

The light weight of the invention is of considerable importance as small watercraft can only support and carry a certain amount of weight. Where the weight and size of items to be included in a kayak or canoe trip is of considerable importance, the size and weight of articles included is scrutinized. The invention is both smaller in size and lighter in weight (mass) than anything else comparable in performance and efficiency at capturing wind power and converting it into force used to power a small watercraft.

Operation of Invention

The invention is presented to the wind in a deployed manner in which the perimeter batten, ring or hoop is deployed and the internal sail area is allowed to fill and capture the wind, converting the apparent wind velocity or power into a driving force used.

The invention may be supported in any manner. It may be hand-held, it may be secured and hoisted into the wind above the paddlers head by using and oar or paddle, or it may be lashed to the deck of a small craft and maintained with the use of lines.

The invention may be set upon the deck of a small craft in its stowed or coiled and folded shape in such a manner that it can be deployed or opened up instantly. This instant self-launching of the invention eliminates timely and cumbersome assembly common to other sailing devices in the field.

Upon the termination of the need for the invention, it can be recoiled and folded into an easily handled shape and size that is approximately 20% of its deployed shape.

DESCRIPTION OF ALTERNATIVE EMBODIMENTS

The invention may be used in any manner to harness and capture the force of the wind. In high wind situations the invention may be used in its undeployed shape to effectively capture the power of the wind.

CONCLUSION, RAMIFICATONS AND SCOPE OF INVENTION

In conclusion, the invention offers many advances upon the current technology and application of technique, ideas and materials as it relates to small watercraft downwind sails. Essentially the invention has transcended the state of the art currently available in the field of downwind smallcraft sails used to harness the power from the wind.

The invention advances the current applications of smallcraft sailing practices by being easier and quicker to set-up and launch. This relates to less time the paddler is required to tie, assemble, rig or otherwise deal with a sail as doing so removes their hands from the capsize-arresting paddle needed for safety.

The invention offers advances such as greater craft stability owing to the fact that the invention provides essentially the same sailing force but with a lower center of gravity due to its light weight is less prone to upset and capsizing small watercraft such as kayaks and canoes.

The invention is lighter in weight than any similar sized small craft sailing item which relates to less mass required to load and carry in a small kayak or other water-craft.

In employing new high elastic and fracture resistant materials, as well as making use of a unique folding and coiling physical property of a circular and perimeter structure, a new and novel sailing device has been invented. This invention is lighter (less massive), simpler (less complex and complicated), and quicker in deploying and stowing than that which is currently available or unavailable in the field of smallcraft sails.

The invention also allows for a greater margin of personal safety when using the invention as compared to similar articles in the field of this invention. This is due to the high degree of watercraft instability inherent when employing other items and inventions in the field.

The invention offers technological advances in the field of smallcraft sailing in terms of weight, simplicity, reductions in size and personal safety.

The invention claimed is:

1. A method of propelling a watercraft by deploying a mastless sail to capture the energy of wind above water, comprising the steps of:

providing a sail, said sail comprising a hollow body having an open front end and a closed rear end, said open front end defining a perimeter sleeve, a perimeter support batten comprising a single, closed-loop resilient structure housed within said perimeter sleeve;

deploying the sail by allowing the perimeter support batten to self expand from a folded configuration to an expanded configuration, whereby in the folded configuration said support batten is coiled upon itself and in the expanded configuration said support batten is shaped as a single, substantially circular loop;

positioning the sail in the wind to capture the energy of the wind, whereby said sail when fully expanded by the captured wind defines a substantially hemispherical shape; and allowing the captured wind to propel the watercraft.

2. The method of claim 1, wherein said sail comprises fabric.

3. The method of claim 1, wherein said sail comprises transparent and/or non-transparent material.

4. The method of claim 1, wherein said closed-loop resilient structure has a rectangular cross section.

5. The method of claim 1, wherein said sail further comprises a plurality of attachment members proximate said open front end for securing said sail to said watercraft.

6. The method of claim 1, wherein said sail further comprises an integral stowage pouch for storing said sail.

7. The method of claim 1, further comprising the steps of stowing said sail by folding said perimeter batten, said folding comprising the steps of twisting said perimeter batten and coiling it upon itself.

* * * * *